US008505128B2

(12) United States Patent
Staudinger

(10) Patent No.: US 8,505,128 B2
(45) Date of Patent: Aug. 13, 2013

(54) REMOVABLE CLOSURE FOR A BATHTUB HAVING A WALK-THROUGH

(76) Inventor: Herbert Staudinger, Newmarket (CA)

( * ) Notice: Subject to any disclaimer, the term of this patent is extended or adjusted under 35 U.S.C. 154(b) by 1577 days.

(21) Appl. No.: 11/735,764

(22) Filed: Apr. 16, 2007

(65) Prior Publication Data

US 2008/0222787 A1 Sep. 18, 2008

Related U.S. Application Data

(60) Provisional application No. 60/894,477, filed on Mar. 13, 2007.

(51) Int. Cl.
*A47K 3/02* (2006.01)

(52) U.S. Cl.
USPC ..... 4/555; 4/538; 4/584

(58) Field of Classification Search
USPC ..... 4/538, 555, 584; 292/256.67, 256.71, 292/256.73, 258, 291, 293, 294, 301, 338, 292/260
See application file for complete search history.

(56) References Cited

U.S. PATENT DOCUMENTS 2,073,755 A * 3/1937 Poate ..... 42/1.06
3,052,942 A * 9/1962 Mulvaney ..... 292/256.71
3,380,078 A * 4/1968 Hanson ..... 4/555
4,542,545 A 9/1985 Johnson et al.
4,796,312 A 1/1989 Corlew
4,953,241 A 9/1990 Williams
D332,827 S 1/1993 Dannenberg et al.
5,184,358 A * 2/1993 Gruidel et al. ..... 4/555
5,628,851 A 5/1997 Lawler
5,701,614 A * 12/1997 Appleford et al. ..... 4/555
5,744,033 A * 4/1998 Bertrand et al. ..... 210/282
6,061,846 A * 5/2000 Peterson ..... 4/555
6,212,704 B1 4/2001 Peterson
6,533,817 B1 * 3/2003 Norton et al. ..... 623/17.16

OTHER PUBLICATIONS

"Magic Bad" Advertisement, Feb. 8, 2008.

* cited by examiner

*Primary Examiner* — Gregory Huson
*Assistant Examiner* — Erin Deery
(74) *Attorney, Agent, or Firm* — Volpe and Koenig, P.C.

(57) ABSTRACT

A closure for a bathtub is disclosed. The bathtub has a walk-through bound by a generally U-shaped structure having a central sill portion and jamb portions projecting upwardly and from opposite ends of said sill portion. The closure comprises an exterior insert and an interior insert. The exterior insert, in use, is disposed exteriorly of the U-shaped structure. The interior insert, in use, is disposed interiorly of the U-shaped structure and releasably secured to the exterior insert to seal against the U-shaped structure to permit the bathtub to be filled to a height above the sill portion.

14 Claims, 9 Drawing Sheets

REMOVABLE CLOSURE FOR A BATHTUB HAVING A WALK-THROUGH

CROSS REFERENCE TO RELATED APPLICATION

This application claims the benefit of U.S. Provisional Patent Application No. 60/894,477 filed Mar. 13, 2007, which is incorporated by reference as if fully set forth.

FIELD OF INVENTION

The present invention relates to the field of bathtubs.

BACKGROUND

Ingress and egress to and from a standard bathtub can be difficult for infirm persons. Bathtubs with doors formed in the sidewalls thereof are known in the prior art. This reduces the problems associated with ingress and egress, but these tubs can be relatively costly to purchase, and renovation of a bathroom to replace an existing tub with a tub of this type has associated inconvenience. It is known to convert a standard bathtub into a bathtub having a walk-through by providing a cut-out in the bathtub and bonding an insert to the tub. However, while this reduces the problems associated with ingress and egress at relatively low cost and with little inconvenience, it results in a tub which is no longer fully-functioning. In long term situations, this can be a sensible compromise. However, where are there additional able-bodied family members in a home who still wish to bathe, or in nursing homes or the like, where the occupier of a room can change relatively frequently, conversion of a tub to a walk-through tub to accommodate an earlier occupant can be problematic.

SUMMARY

A closure for a bathtub having a walk-through forms one aspect of the invention.

The walkthrough is of the type which is bound by a generally U-shaped structure having a central sill portion and jamb portions projecting upwardly and from opposite ends of said sill portion.

The closure comprises an exterior insert and an interior insert. The exterior insert, in use, is disposed exteriorly of the U-shaped structure. The interior insert, in use, is disposed interiorly of the U-shaped structure and releasably secured to the exterior insert to seal against the U-shaped structure to permit the bathtub to be filled to a height above the sill portion.

A closure for a bathtub having a walk-through forms another aspect of the invention.

The walkthrough is of the type which is bound by a generally U-shaped structure having a central sill portion and jamb portions projecting upwardly and from opposite ends of said sill portion. The U-shaped structure has a width greater than that of the sidewall of the bathtub such that the U-shaped structure defines opposed, generally U-shaped protuberances respectively projecting interiorly and exteriorly from the tub sidewall.

The closure comprises an exterior insert and an interior insert. The exterior insert, in use, is disposed exteriorly of the U-shaped structure. The interior insert, in use, is disposed interiorly of the U-shaped structure and releasably secured to the exterior insert to seal against the U-shaped structure to permit the bathtub to be filled to a height above the sill portion.

A conversion system for use with a bathtub forms yet another aspect of the invention. The bathtub has a cut-out corresponding to a portion of the tub sidewall that has been removed, said portion including a length of the ledge of said bathtub. The system comprises a generally U-shaped insert and a closure.

The generally U-shaped insert is, in use, disposed in the cut-out and bonded to the sidewall to define a walk-through in said bathtub. The U-shaped insert has a central sill portion and jamb portions projecting upwardly and from opposite ends of said sill portion in use.

The closure includes an exterior insert and an interior insert. When the U-shaped insert is in use, the exterior insert can be positioned at an operative position whereat it is disposed exteriorly of the U-shaped insert and the interior insert can be positioned at an operative position whereat it is disposed interiorly of the U-shaped insert. The interior insert is adapted to be releasably secured to the exterior insert when the interior and exterior inserts are operatively positioned. When the closure is in use, the exterior and interior inserts are operatively positioned and releasably secured to one another and the interior insert is sealed against the U-shaped insert to permit the bathtub to be filled to a height above the sill portion.

The invention permits a walk-through bathtub to be relatively conveniently converted into a full-depth bathtub, and vice versa, at relatively low cost.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinbelow.

BRIEF DESCRIPTION OF THE DRAWING(S)

DETAILED DESCRIPTION OF THE PREFERRED EMBODIMENT(S)

Figure 4:
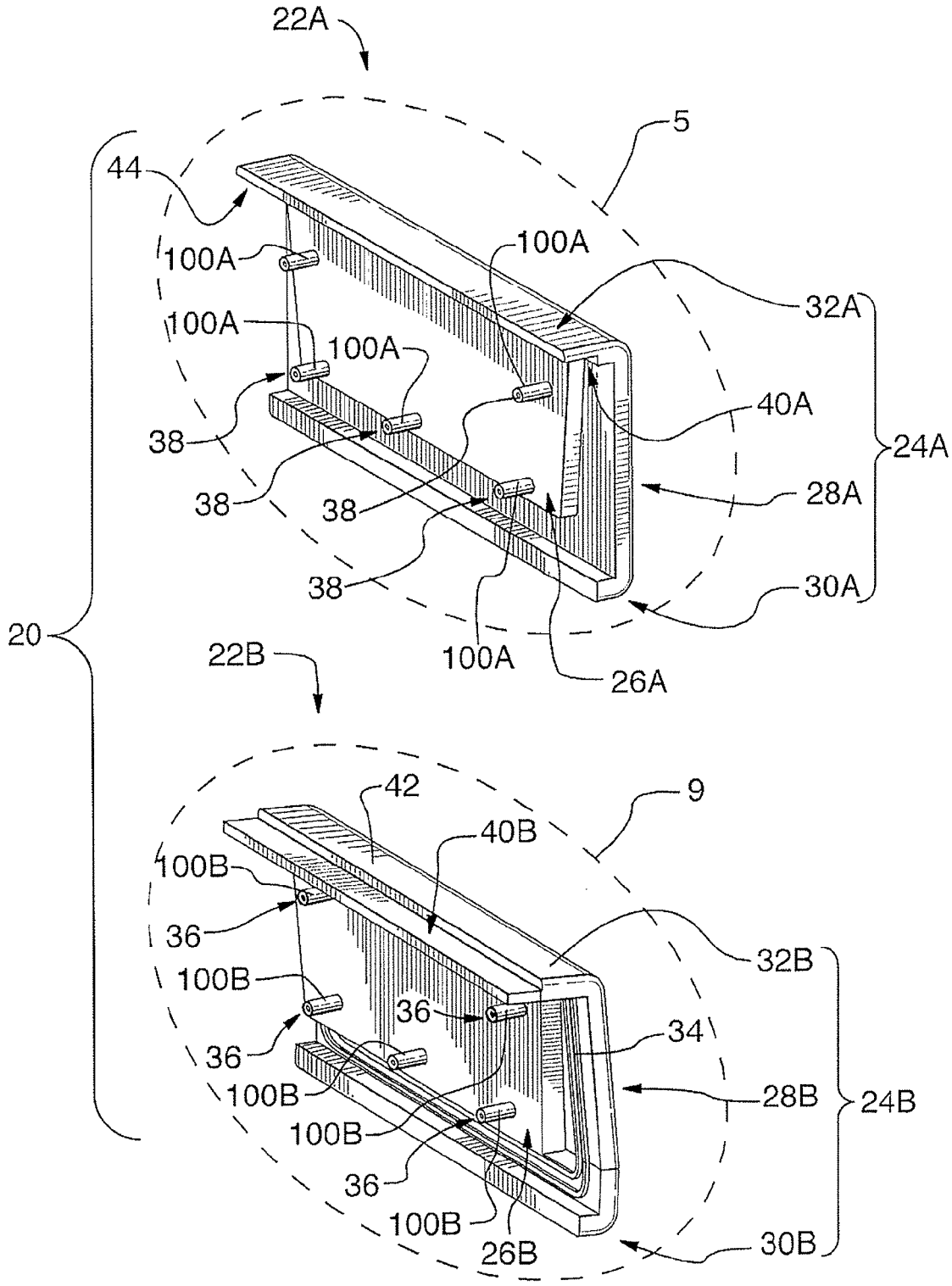
FIG. 4 is a perspective view of a closure according to a preferred embodiment of the invention.
Figure 5:
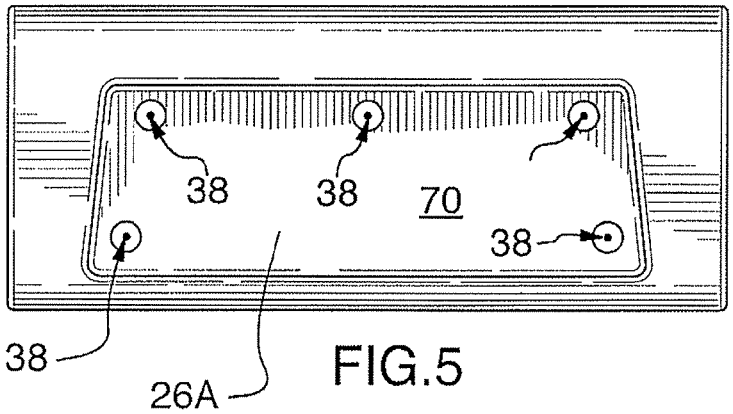
FIG. 5 is a front elevational view of the structure in encircled area 5 of FIG. 4.
Figure 6:
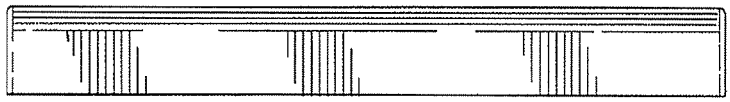
FIG. 6 is a top plan view of the structure of FIG. 5.
Figure 7:
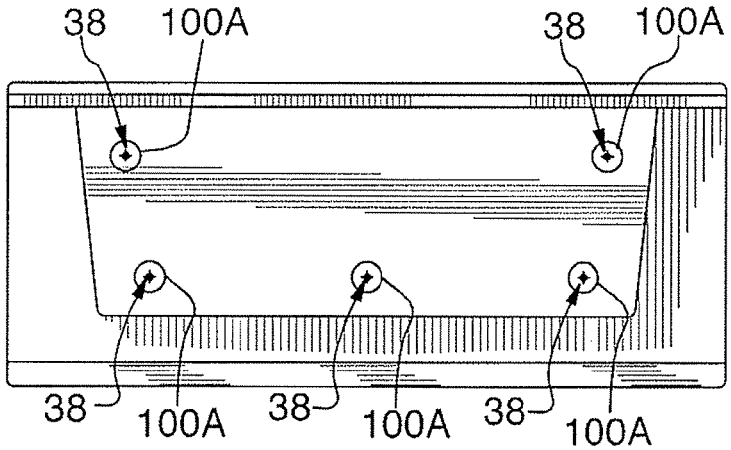
FIG. 7 is a rear elevational view of the structure of FIG. 5.
Figure 8:
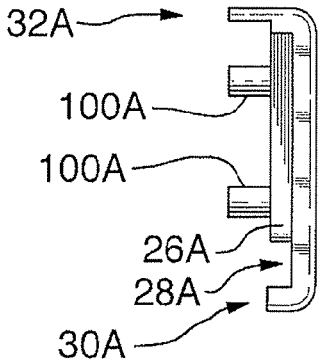
FIG. 8 is an end elevational view of the structure of FIG. 5.
Figure 9:
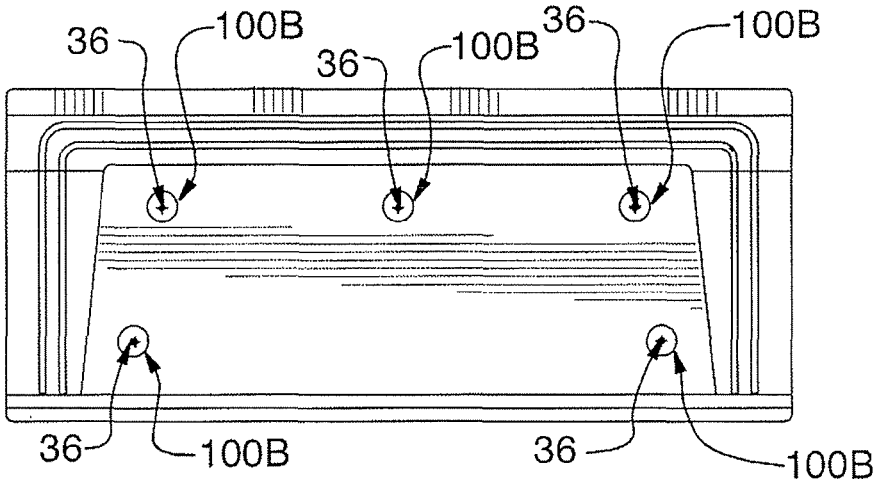
FIG. 9 is a front elevational view of the structure in encircled area 9 of FIG. 4.
Figure 10:
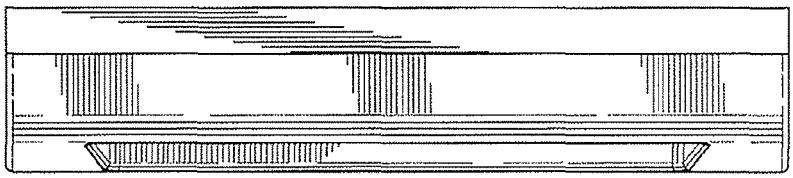
FIG. 10 is a top plan view of the structure of FIG. 9.
Figure 11:
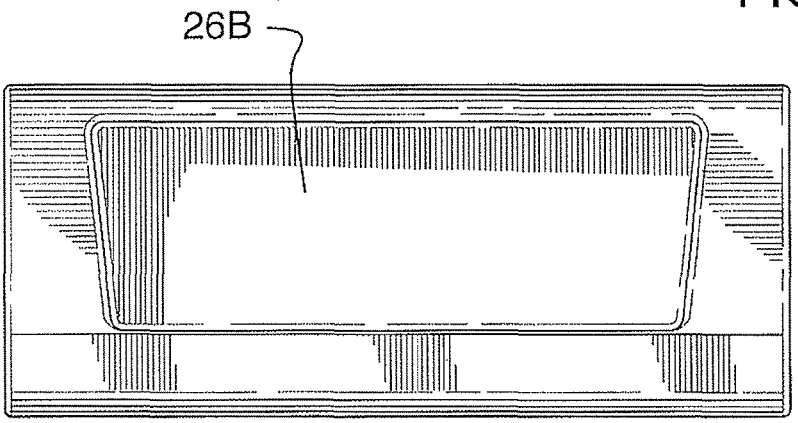
FIG. 11 is a rear elevational view of the structure of FIG. 9.
Figure 12:
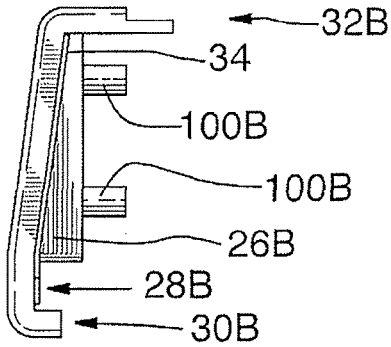
FIG. 12 is an end elevational view of the structure of FIG. 9.
Figure 13:
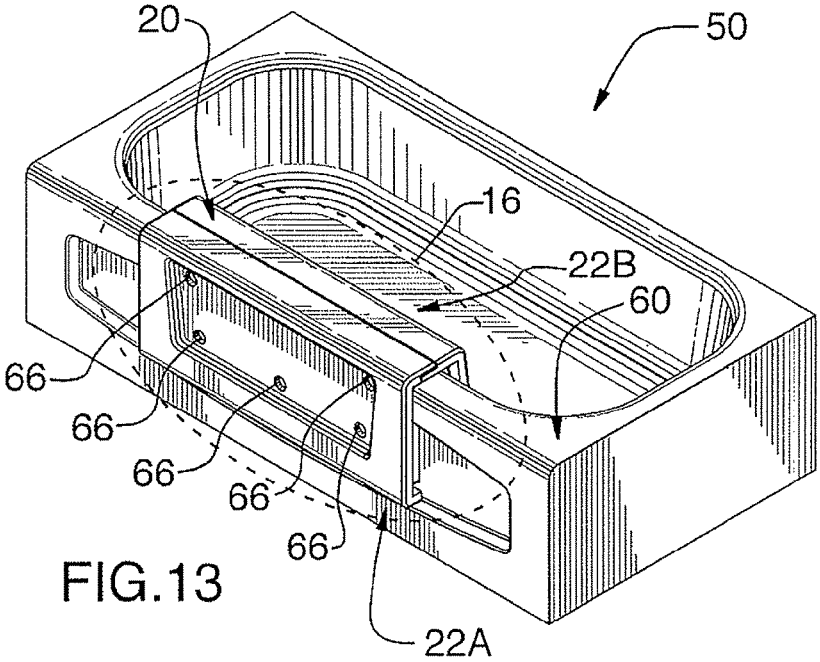
FIG. 13 is a front, side, top isometric view of the structure of FIG. 4 in use with the structure of FIG. 1.
Figure 14:
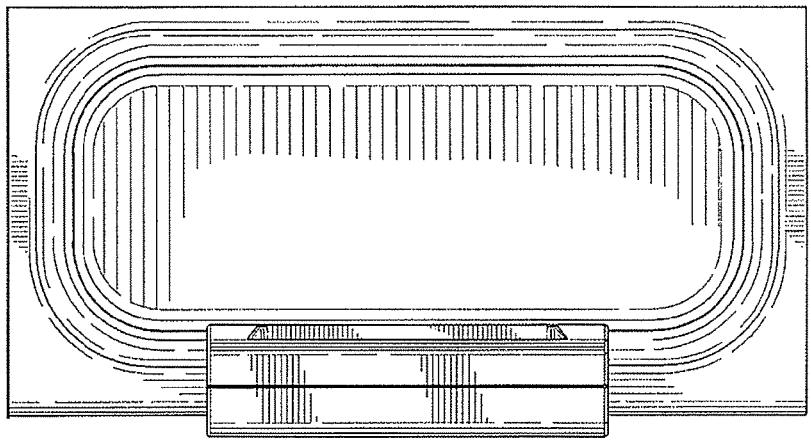
FIG. 14 is a top plan view of the structure of FIG. 13.
Figure 15:
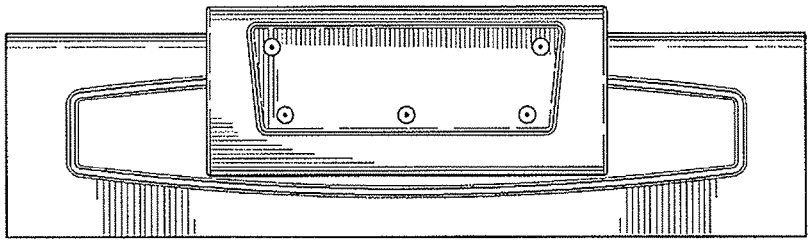
FIG. 15 is a front elevational view of the structure of FIG. 13.
Figure 16:
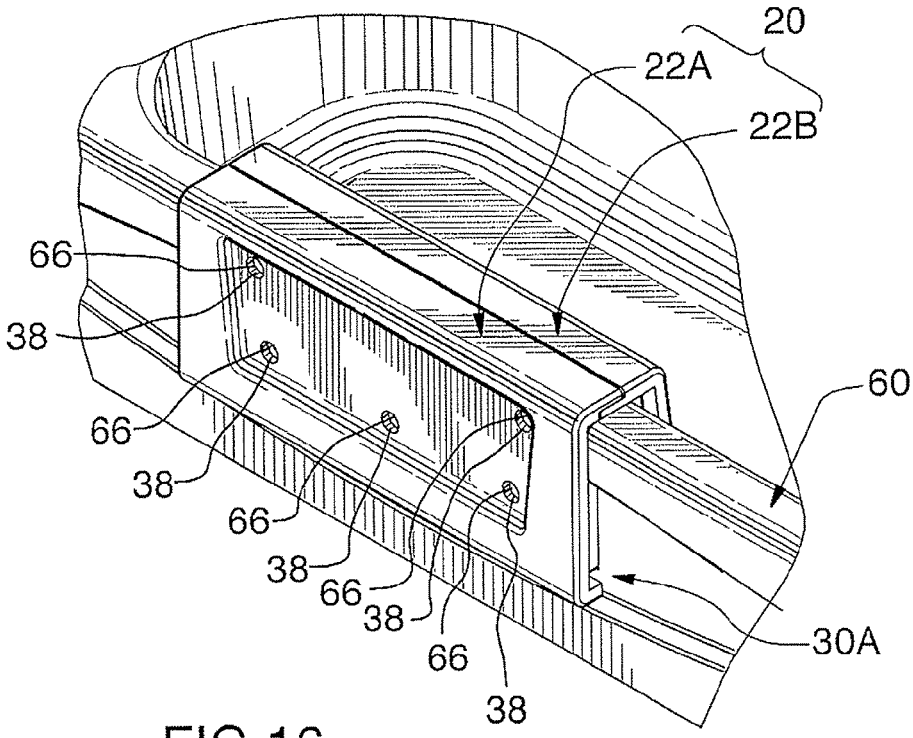
FIG. 16 is an enlarged front view of the structure of encircled area 16 in FIG. 13.
Figure 17:
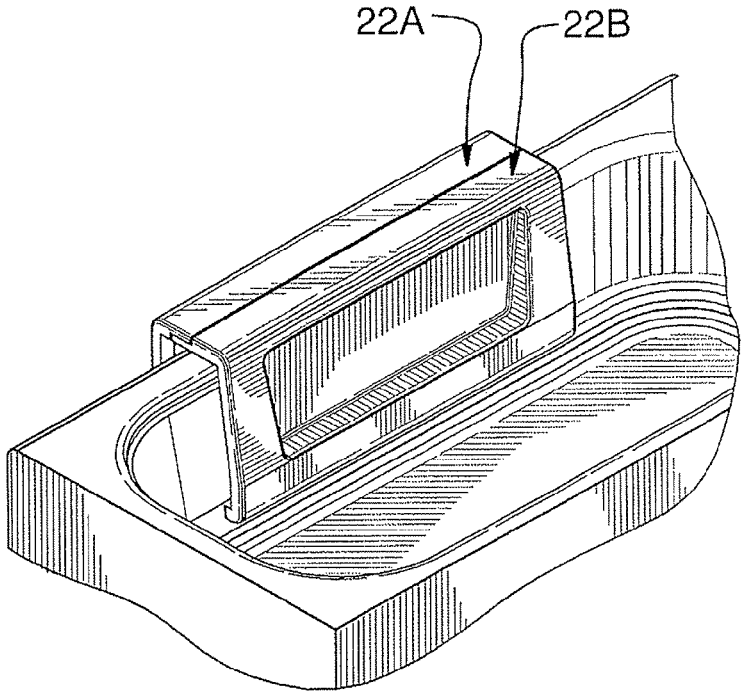
FIG. 17 is an enlarged rear view of the structure of FIG. 16.
Figure 18:
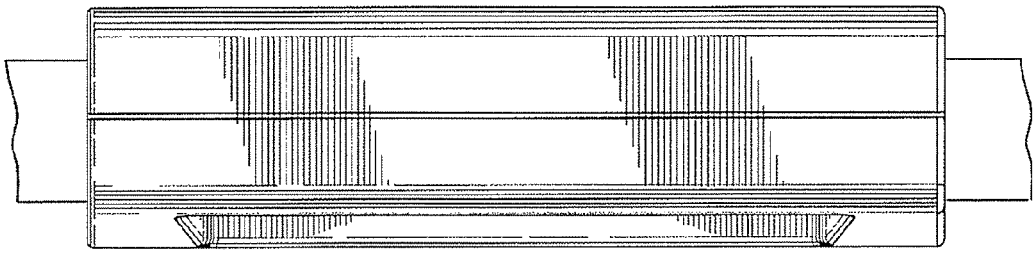
FIG. 18 is an enlarged top view of a portion of the structure of FIG. 14.
Figure 19:
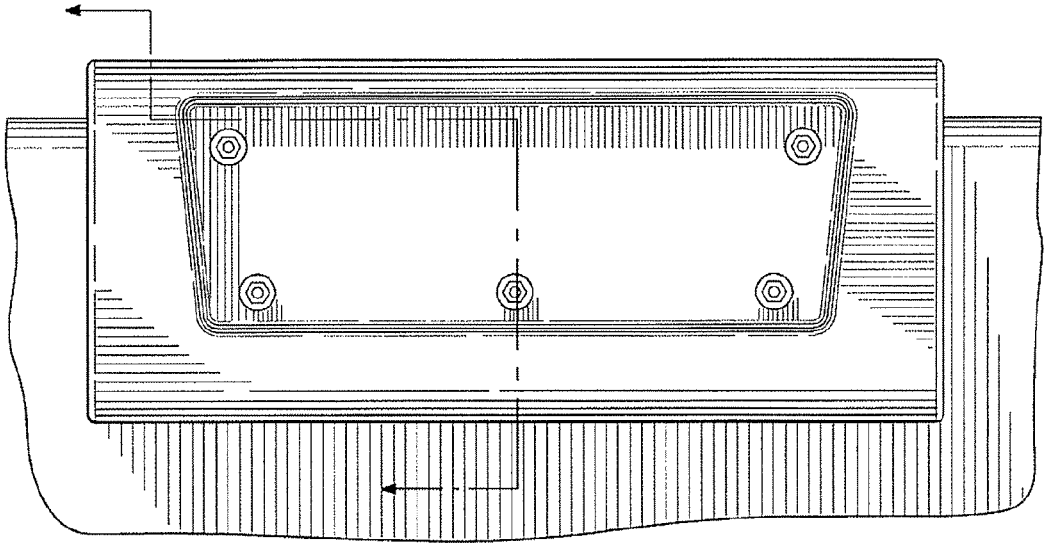
FIG. 19 is a front view of the structure of FIG. 18.

With general reference to FIG. 4, a preferred embodiment of the present invention, a closure, is illustrated, and is designated by general reference numeral 20.

The closure 20 comprises an exterior insert 22A and an interior insert 22B. With reference to FIGS. 4-12, each of the inserts 22A, 22B includes a main body portion 24A,24B, an inset or hollow portion 26A,26B and a plurality of protuberances 100A, 100B. The main body portion 24A,24B has a substantially C-shaped profile defined by a cover portion 28A,28B and a lip 30A,30B and a flange 32A,32B which extend therefrom. The inset or hollow portion 26A,26B extends from the cover portion 28A,28B between the lip 30A,30B and flange 32A,32B.

In each insert, the protuberances extend from the inset portion in the same direction as that in which the inset portion extends from the cover portion. The interior insert 22B has a U-shaped dual gasket 34 extending from the cover portion 28B around the bottom and sides of inset portion 26B. An interiorly-threaded bore 36 is defined in the end of each protuberance 100B. A bolt passage 38 extends through each protuberance 100A and exits through inset portion 26A. The flange 32B of the interior insert 22B has a cut-away 40B on an upper surface 42 thereof. The flange 32A of the exterior insert 22A has a cut-away 40A on a lower surface 44 thereof. Each of the exterior insert 22A and the interior insert 22B is an injection-molded ABS plastic product. The dual gasket 34 may be molded contemporaneously with the interior insert 22B or can at a later point be press-fit into a pre-made groove or secured by adhesive, sonic welding or the like.

Figure 1:
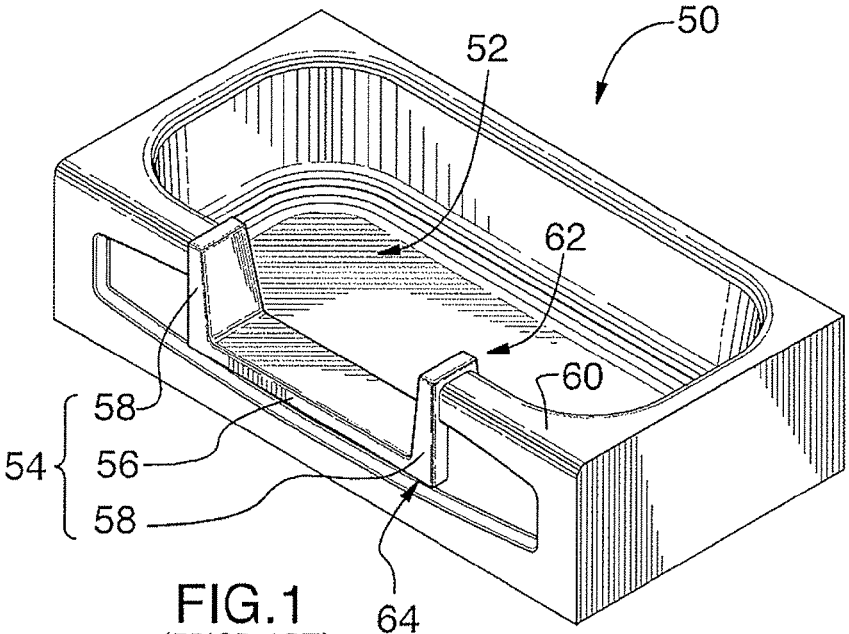
FIG.1 (PRIOR ART)
FIG. 1 is a front, side, top isometric view of a prior art walk-through tub.
Figure 2:
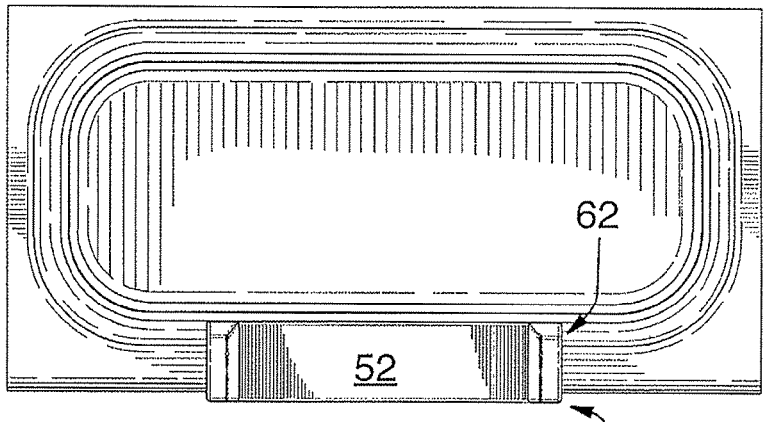
FIG.2 (PRIOR ART)
FIG. 2 is a top plan view of the structure of FIG. 1.
Figure 3:
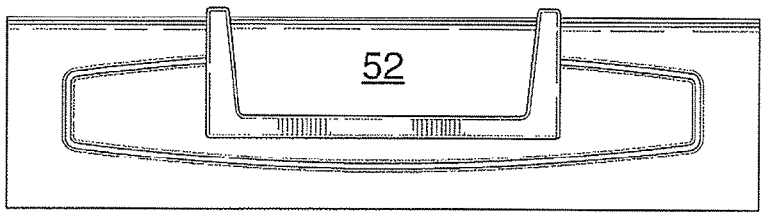
FIG.3 (PRIOR ART)
FIG. 3 is a front elevational view of the structure of FIG. 1.

The closure 20 is for a bathtub 50 as shown in FIGS. 1-3. This tub 50 is of a type known in the prior art and has a walk-through 52. Walkthrough 52 is bound by a generally U-shaped structure 54, specifically, a threshold insert, having a central sill portion 56 and jamb portions 58 projecting upwardly and from opposite ends of said sill portion 56. As best seen in FIG. 2, the threshold insert 54 has a width greater than that of the sidewall 60 of the bathtub such that the threshold insert 54 defines opposed, generally U-shaped protuberances 62,64 respectively projecting interiorly and exteriorly from sidewall 60.

The closure 20 is shown in use in FIGS. 13-20. Herein, the exterior insert 22A is disposed exteriorly of the threshold insert 54 and against the protuberance 64 (neither visible) projecting exteriorly from the tub sidewall 60 in a non-watertight manner. The interior insert 22B is disposed interiorly of the threshold insert 54 and releasably secured to the exterior insert 22A by fastening bolts 66 which extend through the screw passages 38 of the exterior insert 22A into the threaded bores 36 of the interior insert 22B. This brings dual gaskets 34 of interior insert 22B into operative position whereat same follow and are sealingly disposed in a watertight manner against protuberance 62 projecting interiorly from tub sidewall 60. Since the gaskets 34 of the interior insert 22B are sealingly disposed in a watertight manner and the exterior insert 22A is disposed in a non-watertight manner, any leaks or improper seating of the interior insert 22B are detectable.

The interior insert 22B thus forms an extension of the tub sidewall 60, to occlude the walkthrough 52 and permit the bathtub 50 to be used in the manner for which it was originally designed, i.e., it permits the bathtub 50 to be filled to a height above the sill portion 56. When so filled, the water pressure exerts an upward (buoyant) and outward force on the interior insert 22B. The outward force is, of course, countered by tub sidewall 60, against which interior insert 22B effectively rests by virtue of the connection between the threshold insert 54 and the tub sidewall 60, best seen in FIG. 20. The upward force is countered by a mechanical engagement between the closure 20 and the threshold insert 54, specifically, by the lips 30A,30B, which project under the sill portion 56 so as to restrain the closure 20 against upward motion.

Figure 21:
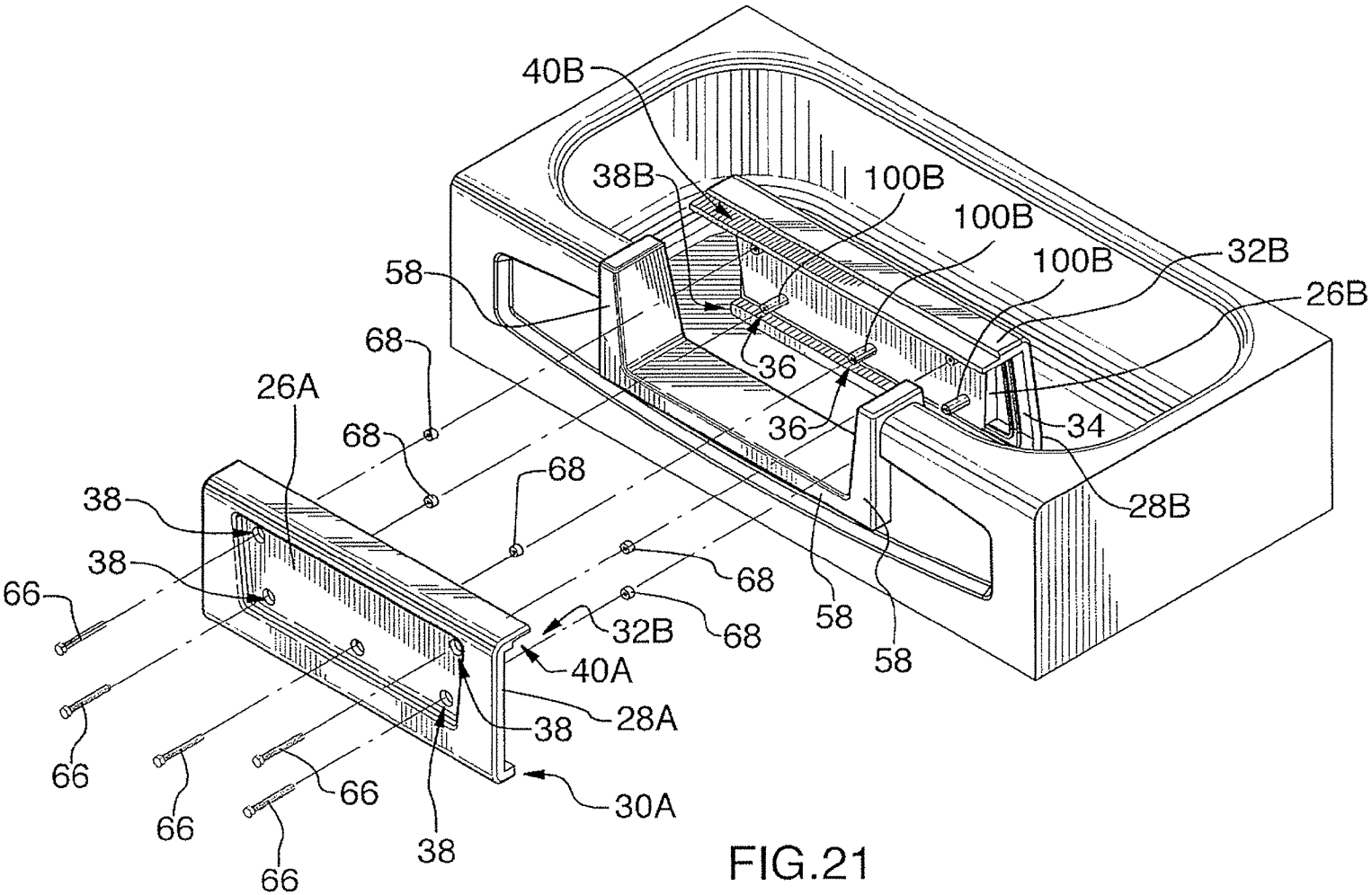
FIG. 21 is an exploded view of a structure similar to that of FIG. 13.

It is known that threshold inserts of the general type illustrated in use in FIG. 1 have heretofore been provided in varying shapes and sizes. This closure 20 accommodates slight variations without any necessary modifications, since the cut-away 40A,40B portions provide for the flanges 32A, 32B to meet in a half-lap joint, best seen in FIG. 20, which can accommodate changes in the width of the threshold insert 54 while still providing an extension of the bathtub ledge that is neat in appearance (the flanges 32A,32B also restrain the closure 20 against downward motion).

Where the closure 20 is to be used with a threshold insert 54 of larger-than-normal width, it may be desirable to provide spacers 68 between the protuberances 100A,100B and through which the fasteners 66 pass, as shown in FIG. 21, to minimize any unsupported space therebetween and avoid the potential for the connecting bolts 66 to be overtightened and pull through the inset portion 26A.

Similarly, if the threshold insert 54 with which the closure 20 is to be used is of smaller-than-normal height, it may be desirable to position spacers on the underside of the flanges (not shown), so as to ensure that the gasket 34 is properly positioned.

Whereas but a single embodiment of the present invention has been herein shown and described, it will be understood that various changes in parts, including changes in size and shape and other substitutions, may be made.

For example, only, whereas a double gasket is shown, a single gasket, or three or more gaskets, could be provided instead.

Figure 20:
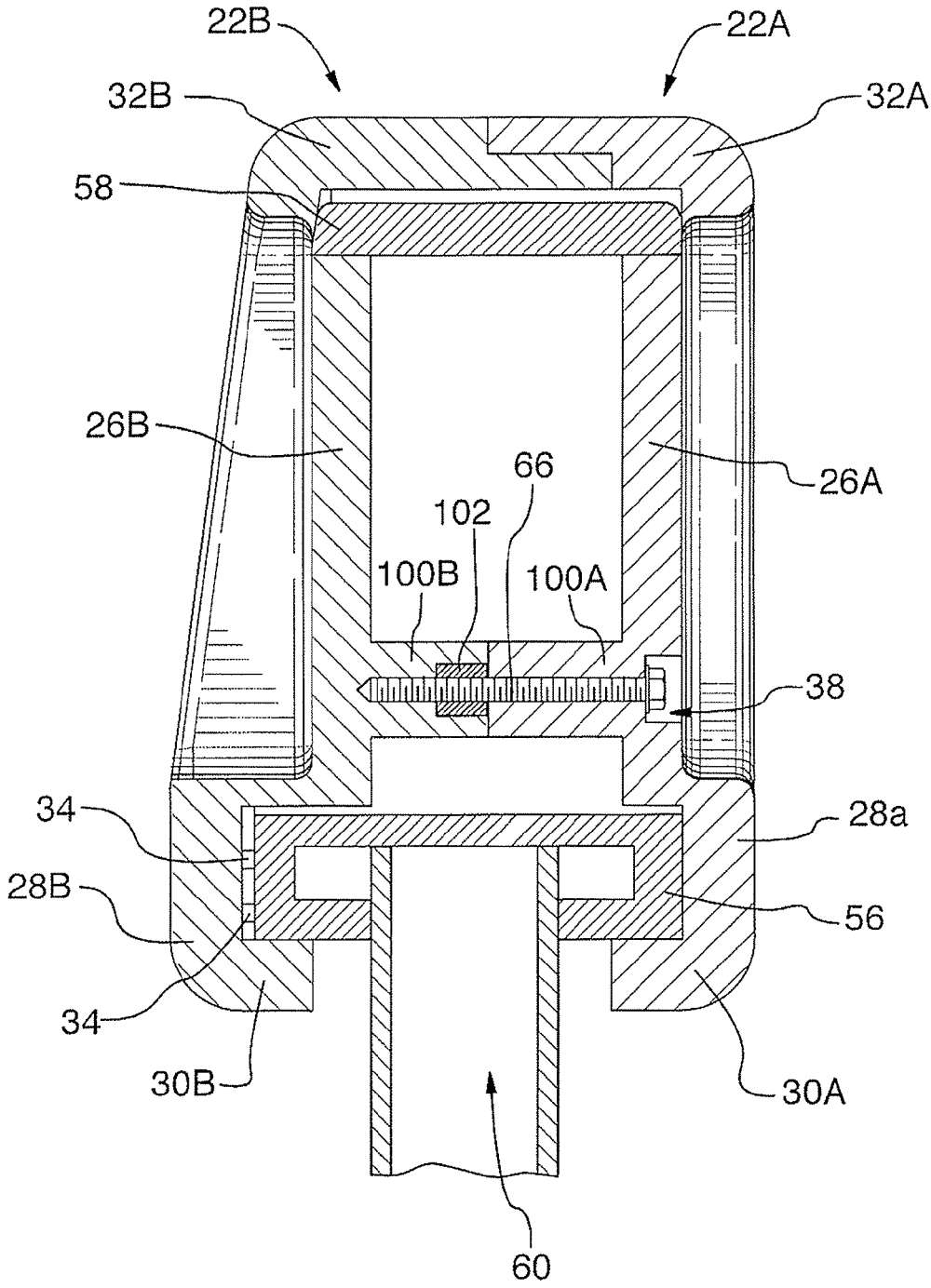
FIG. 20 is a sectional view along 20-20 of FIG. 19.

Additionally, although in the preferred embodiment illustrated, the threaded bores are defined in molded-in inserts 102 of relatively tougher material than the balance of the closure 20, as best seen in FIG. 20, this is not necessary. The threaded bores could readily be defined in the plastic material which forms the closure.

Similarly, whereas flanges are shown on the closure illustrated, same could readily be removed. Further, whereas the inserts illustrated include inset or hollow portions, which has aesthetic appeal and minimizes plastic utilization, these could readily be avoided.

Further, whereas the description thus far describes a closure for use with a bathtub of the type having a threshold insert already installed, it should be understood that the closure could be sold as part of a conversion system which includes a closure and a threshold insert, for use with a tub. A purchaser of the system could remove a portion of the tub sidewall, including a length of the ledge of said bathtub, and bond or secure the threshold insert in a conventional manner to the sidewall to define a walk-through in said bathtub. The manner in which the bathtub sidewall is partially removed, the construction of the threshold insert and the manner in which the threshold insert is secured to the tub sidewall could all be as known in the prior art, for example, as described in U.S. Pat. Nos. 6,061,846 and 6,212,704, issued to Peterson on May 16, 2000 and Apr. 10, 2001, respectively. Thereafter, when it was desired to reconfigure the bathtub for normal bathing, the closure sold as part of the system could be put into use, as previously described herein.

Moreover, whereas the closure is described to be constructed largely out of injection-molded ABS, other plastics and other molding processes, such as blow molding, rotational molding and reaction injection molding can be utilized.

As well, whereas bolts or screws are described and shown, other fasteners could be employed in the place thereof, such as quick change/quarter turn fasteners or the like.

As well, the closure could be used in association with a tub manufactured, rather than retrofitted, with a walk-through, i.e. the U-shaped threshold structure would not be an insert, but would be formed integrally with the tub sidewall.

If the closure were sold as part of a system, or as an option to a tub manufactured with a walk-through, insets could be provided in the front and rear surfaces of the threshold structure, such that the closure did not protrude beyond the threshold structure in use. Similarly, other forms of mechanical engagement as between the closure and the threshold structure could be provided, such as detents and corresponding recesses on the components, to avoid the need for the lips.

In view of the foregoing, it should be understood that the invention is limited only by the claims appended hereto, purposely construed.

What is claimed is:

1. A closure for a bathtub having a walk-through, said walkthrough being bound by a generally U-shaped structure having a central sill portion and jamb portions projecting upwardly and from opposite ends of said sill portion, the U-shaped structure having a width greater than that of the sidewall of the bathtub such that the U-shaped structure defines opposed, generally U-shaped protuberances respectively projecting interiorly and exteriorly from the tub sidewall, said closure comprising:

an exterior insert, said exterior insert, in use, being disposed exteriorly of the U-shaped structure; and an interior insert, said interior insert, in use, being disposed interiorly of the U-shaped structure and releasably secured to the exterior insert to seal against the U-shaped structure to permit the bathtub to be filled to a height above the sill portion;

wherein, in use, the interior insert is sealed in a watertight manner against the protuberance projecting interiorly from the sidewall and the exterior insert is disposed in a non-watertight relation against the protuberance projecting exteriorly from the sidewall thereby permitting leaks of the interior insert seal to be detected.

2. A closure according to claim 1, wherein, in use, the exterior insert and the interior insert are restrained against upward motion by mechanical engagement with the U-shaped structure.

3. A closure according to claim 1, wherein each of the inserts has a lip which projects under the sill portion in use so as to restrain the closure against upward motion.

4. A closure according to claim 1, wherein each of the inserts has a flange which flanges, in use, collectively define an extension of the bathtub ledge and restrain the closure against downward motion.

5. A closure according to claim 1, wherein each of the inserts has a flange which flanges, in use, meet in a half lap joint overlying the U-shaped structure.

6. A closure according to claim 1, wherein the inserts are releasably secured together in use by screws.

7. A closure according to claim 1, wherein the inserts are releasably secured together in use by screws which extend through the exterior insert into the interior insert.

8. A closure according to claim 1, wherein the interior insert has a U-shaped gasket following and disposed against the protuberance projecting interiorly from the sidewall in use.

9. A conversion system for use with a bathtub having a cut-out corresponding to a portion of the tub sidewall that has been removed, said portion including a length of the ledge of said bathtub, said system comprising:

a generally U-shaped insert disposed in the cut-out and secured in use to the sidewall to define a walk-through in said bathtub, said insert having a central sill portion and jamb portions projecting upwardly and from opposite ends of said sill portion in use, the U-shaped insert having a width greater than that of the sidewall of the bathtub such that the U-shaped insert defines opposed, generally U-shaped protuberances respectively projecting interiorly and exteriorly from the tub sidewall; and a closure including:

an exterior insert positionable, when the U-shaped insert is in use, at an operative position whereat the exterior insert is disposed exteriorly of the U-shaped insert; and an interior insert positionable, when the U-shaped insert is in use, at an operative position whereat the interior insert is disposed interiorly of the U-shaped insert, the interior insert being adapted to be releasably secured to the exterior insert when the interior and exterior inserts are operatively positioned, wherein, when the closure is in use, the exterior and interior inserts are operatively positioned and releasably secured to one another and the interior insert is sealed against the U-shaped insert to permit the bathtub to be filled to a height above the sill portion and wherein, in use, the interior insert is sealed in a watertight manner against the protuberance projecting interiorly from the sidewall and the exterior insert is disposed in a non-watertight relation against the protuberance projecting exteriorly from the sidewall thereby permitting leaks of the interior insert seal to be detected.

10. A system according to claim 9, wherein each of the inserts has a lip which projects under the sill portion in use so as to restrain the closure against upward motion when the closure is in use.

11. A system according to claim 9, wherein each of the inserts has a flange which flanges collectively define an extension of the bathtub ledge and restrain the closure against downward motion when the closure is in use.

12. A system according to claim 9, wherein each of the inserts has a flange which flanges meet in a half lap joint overlying the U-shaped structure when the closure is use.

13. A system according to claim 9, wherein the inserts are releasably secured together by screws which extend through the exterior insert into the interior insert when the closure is in use.

14. A system according to claim 9, wherein the interior insert has a U-shaped gasket following and disposed against the protuberance extending interiorly from the sidewall when the closure is in use.

* * * * *